US005647130A

United States Patent [19]

Collins

[11] Patent Number: 5,647,130

[45] Date of Patent: Jul. 15, 1997

[54] KNIFE AND SHEATH WITH TWIST RELEASE MECHANISM

[76] Inventor: Walter W. Collins, P.O. Box 100 4651 Savannah Hwy., North, S.C. 29112

[21] Appl. No.: 582,370

[22] Filed: Jan. 11, 1996

[51] Int. Cl.[6] ..... B26B 29/02

[52] U.S. Cl. ..... 30/151; 30/162; 224/232

[58] Field of Search ..... 30/151, 162; 224/232, 224/233

[56] References Cited

U.S. PATENT DOCUMENTS

| | | | |
|---|---|---|---|
| 2,783,536 | 8/1957 | McQueary | 224/232 |
| 3,992,776 | 11/1976 | Koppe et al. | 30/151 |
| 4,558,516 | 12/1985 | Collins | 224/232 X |
| 5,002,213 | 3/1991 | Newton et al. | 224/232 |
| 5,031,810 | 7/1991 | Finn et al. | 224/151 |
| 5,138,516 | 8/1992 | Collins | 30/151 |
| 5,146,684 | 9/1992 | Hagler | 30/162 |
| 5,163,592 | 11/1992 | Newton et al. | 224/197 |
| 5,255,436 | 10/1993 | Yoshida | 30/151 |

FOREIGN PATENT DOCUMENTS

| | | | |
|---|---|---|---|
| 908850 | 4/1946 | France | 30/151 |

*Primary Examiner*—Douglas D. Watts

*Attorney, Agent, or Firm*—Leatherwood Walker Todd & Mann

[57] ABSTRACT

A locking knife and sheath combination having a knife which is automatically locked to the sheath upon insertion of the knife therein. Laterally extending members of the knife handle contact and engagement member pivotally connected to the front of the sheath upon twisting movement of the handle in order to unlock the knife from the sheath.

15 Claims, 6 Drawing Sheets

KNIFE AND SHEATH WITH TWIST RELEASE MECHANISM

BACKGROUND OF THE INVENTION

This invention relates generally to a knife and sheath combination having a system for locking the knife in the sheath and for allowing unlocking of the knife from the sheath through use of a twisting motion being applied to the knife.

Fixed blade knives are typically provided with a sheath in order to both protect the blade during non-use of the knife, and also to prevent inadvertent injury which could result from the sharpened edge of the blade should the knife blade be exposed. Sheaths are typically constructed of leather or durable fabric, such as canvas or nylon, but may also be constructed of plastic or other materials. The most commonly known sheaths provide a receptacle for the blade and also a loop for allowing the sheath and knife to be carried by a user on his or her belt. The knife can typically be either inserted or withdrawn from the receptacle of the sheath with ease.

A problem with such sheaths is that the knife, if not locked to the sheath in some manner, can easily become disengaged from the sheath and fall out. While this may not present a problem in numerous applications where the sheath is carried in a substantially vertical configuration which allows the knife to reside in the sheath due to the force of gravity, there are circumstances where a sheath may encounter angular configurations other than vertical. For example, a rock climber wearing such a conventional sheath may cause the sheath to be presented in various angular configurations, including upside down. This could cause the knife to fall out of the sheath if some locking means is not provided. Another situation could be in underwater applications, such as for scuba divers. Because a diver could be in any number of positions, some sort of locking means needs to be provided for securely retaining the knife in the sheath. Of course, there are other examples where a locking knife and sheath would be desirable, such as in skydiving, for paratroopers, horseback riders, hunters, etc.

Various knife and sheath designs have been patented. For example, U.S. Pat. No. 5,146,684, issued to Hagler, discloses a sheath having an opening for receipt of a handle ridge provided a knife handle. U.S. Pat. No. 2,783,536, issued to McQueary, discloses a knife having a handle with a groove provided therein for receipt of a rib provided in the sheath.

U.S. Pat. No. 5,255,436, issued to Yoshida, discloses a sheath having a pivotal locking member for engaging a knife handle. U.S. Pat. No. 3,992,776, issued to Koppe, et al., discloses a sheath having a spring for engaging the blade of a knife.

U.S. Pat. Nos. 5,163,592 and 5,002,213, both issued to Newton, et al., disclose knife and sheath retention members, as does also U.S. Pat. No. 5,031,810, issued to Finn, et al.

French Patent Document No. 908,850 appears to disclose a spring member provided on a sheath for engaging with the handle and knife.

While the foregoing knife and sheath designs are known, there still exists a need for a knife and sheath which can be economically produced and which provide for an quick and easy locking and unlocking system.

In providing a locking arrangement for locking a knife in a sheath, it would be desirable to have a locking arrangement that could be operated by a user wearing thick gloves, such as that which may be worn by a scuba diver, climber, outdoorsman, or the like, and additionally, which could be actuated by a user having limited mobility in his or her hands or fingers, such as by someone having arthritis or injury. Such a locking arrangement would allow for easy insertion and positive locking of the knife in the sheath and would also allow for the knife to be readily withdrawn from the sheath.

SUMMARY OF THE INVENTION

It is, therefore, the principal object of this invention to provide a knife and sheath combination which provides a locking mechanism which is quick and easy to use.

It is another object of the present invention to provide a knife and sheath combination which is of relatively economical manufacture.

It is still another object of the present invention to provide a knife and sheath combination which reduces the likelihood of the knife being inadvertently withdrawn from the sheath.

It is yet another object of the present invention to provide a knife and sheath combination which provides a locking mechanism that is locked automatically through generally linear insertion of the knife in the sheath and is unlocked through twisting of the knife with respect to the sheath.

Yet another object of the present invention is to provide a locking arrangement for locking a knife in a sheath which can be actuated by a user wearing gloves and/or having limited hand or finger mobility.

It is a still further object of the present invention to provide a method of constructing and using a knife and sheath combination designed in accordance with the present invention.

Generally, the present invention includes a knife and sheath combination comprising a knife having a blade with a handle defining a blade guard adjacent the blade. The blade guard has at least one transversely extending lifting member extending outwardly from the handle, and the handle also defines a notch laterally spaced from the transversely extending lift member.

A sheath is provided having a body portion defining a blade receptacle for receiving the blade and a back portion extending from the blade receptacle. The sheath includes an engagement member having an engagement tab extending outwardly therefrom and a lateral engagement surface laterally spaced from the engagement tab. The engagement member is connected to the body member for movement between a locking position, wherein the engagement tab engages the notch in the handle upon receipt of the blade by the blade receptacle to lock the blade in the blade receptacle, and an unlocking position, wherein the tab is disengaged from the notch for allowing release of the knife from the sheath. The engagement member is moved from the locking position to the unlocking position through contact of the transversely extending lifting member with the lateral engagement surface, brought about by a twisting motion being applied to the knife handle.

The present invention also includes a method for constructing and using a knife and sheath combination in accordance with the present invention.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
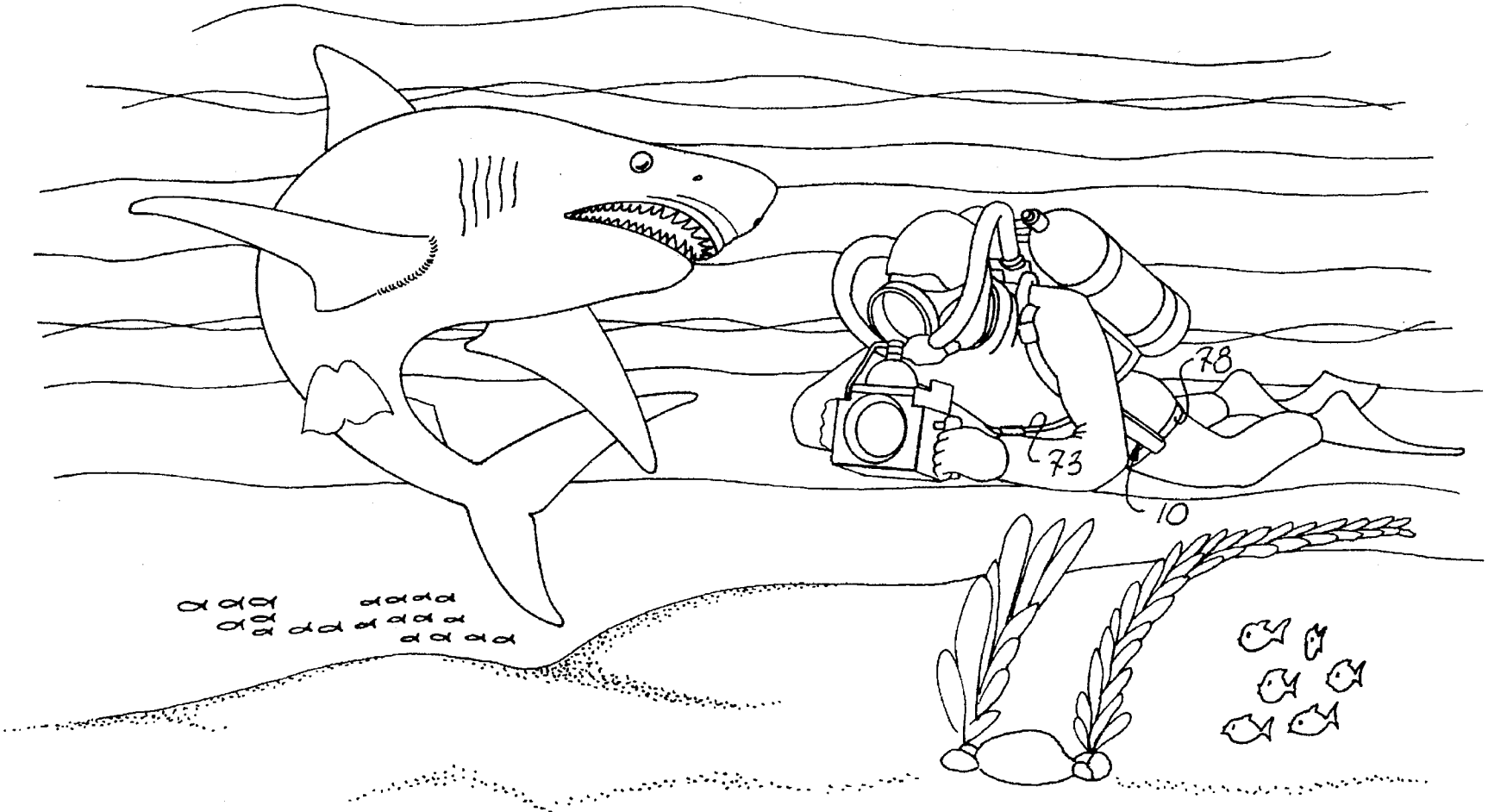
FIG. 1 is a perspective view of a diver using a knife and sheath with a twist release mechanism as disclosed by the present invention.

The accompanying drawings and the description which follows set forth this invention in its preferred embodiment. However, it is contemplated that persons generally familiar with knives and sheaths will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the knife and sheath combination of the present invention is indicated generally in the figures by reference character 10.

FIG. 1 illustrates the knife and sheath combination 10 of the present invention being worn underwater by a scuba diver. In such an environment, the advantages of the present invention can be particularly realized, although it is to be understood that the knife and sheath combination 10 of the present is not limited to underwater use, but could find use in virtually any instance where sheath knives could find application.

Figure 2:
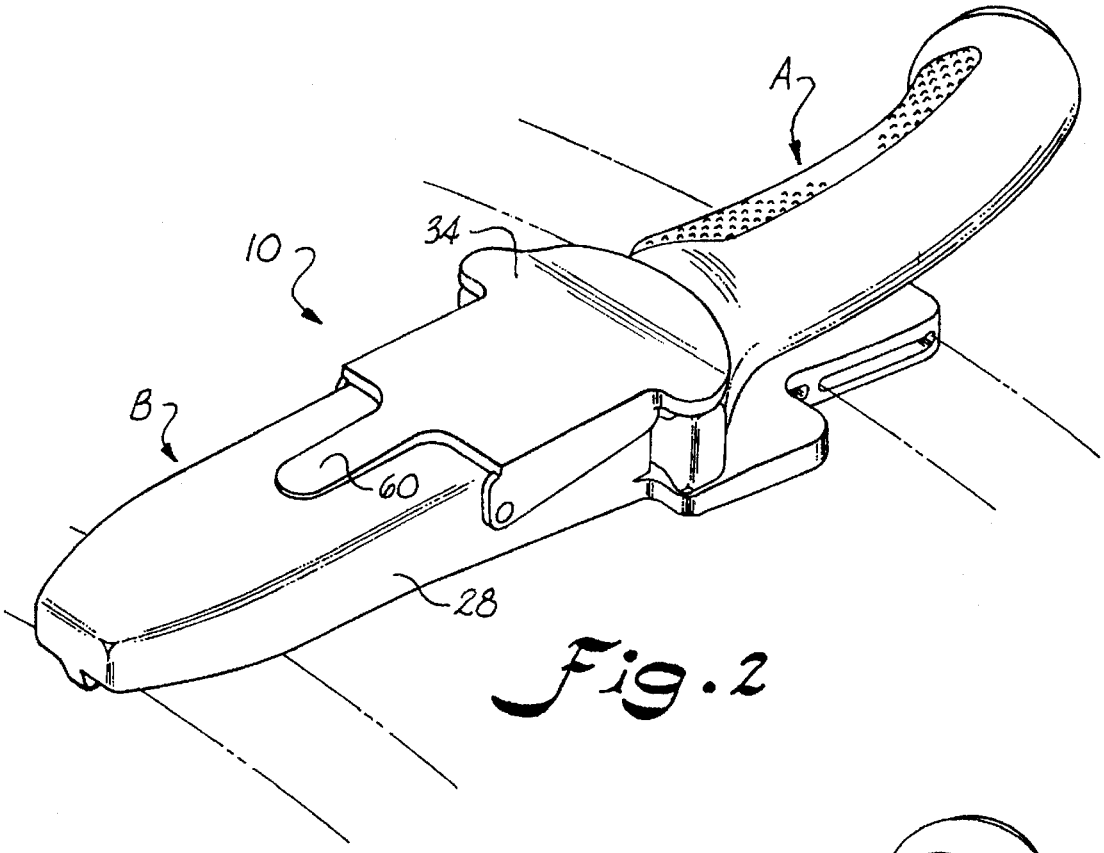
FIG. 2 is a perspective view of a knife and sheath with a twist mechanism constructed in accordance with the present invention.

FIG. 2 illustrates a more detailed view of the knife and sheath combination 10 of the present invention wherein a knife, generally A, is shown in FIG. 2 as being locked within sheath, generally B.

Figure 3:
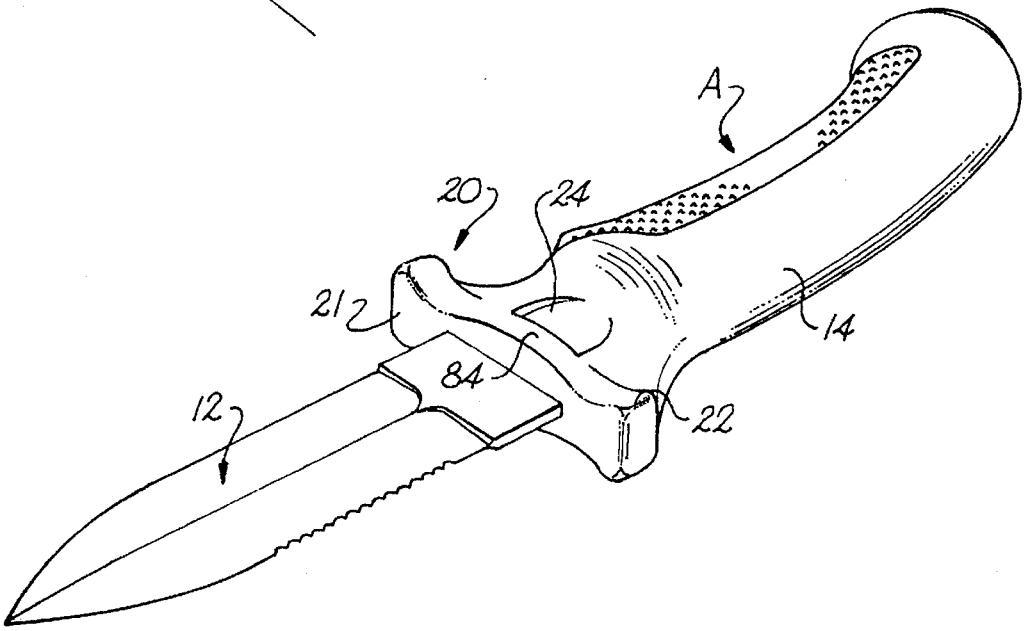
FIG. 3 is a perspective view of a knife constructed in accordance with the present invention.

As illustrated in FIG. 3, knife A, includes a blade 12, with a handle, generally 14, connected thereto. A longitudinal axis 18 runs through handle 14, and is the axis about which handle 18 is preferably generally rotated or twisted during extraction of knife A from sheath B, in a manner discussed in more detail below. Knife A further includes a blade guard, generally 20, adjacent blade 12. The blade guard 20 runs substantially transversely with respect to blade 12 and at the extremities 21, 22 thereof is provided with enlarged lifting members. Handle 14 of the knife also includes a notch 23, 24 on each side, respectively, of handle 14 adjacent blade guard 20.

Figure 4:
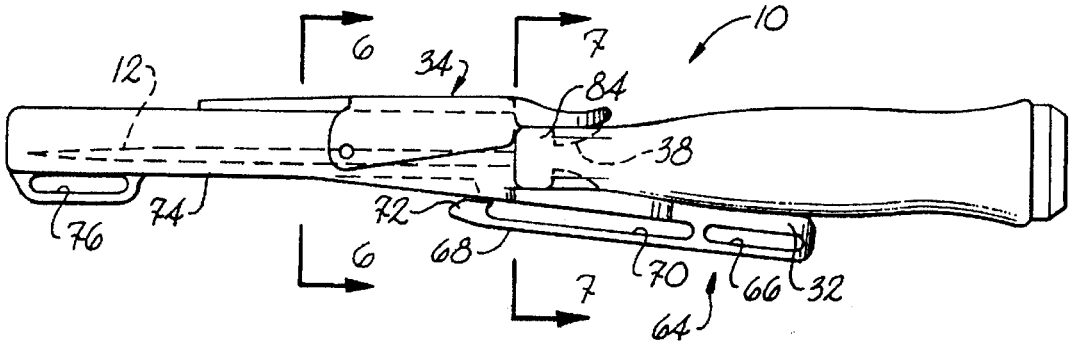
FIG. 4 is a side elevational view of a knife and sheath combination constructed in accordance with the present invention.
Figure 5:
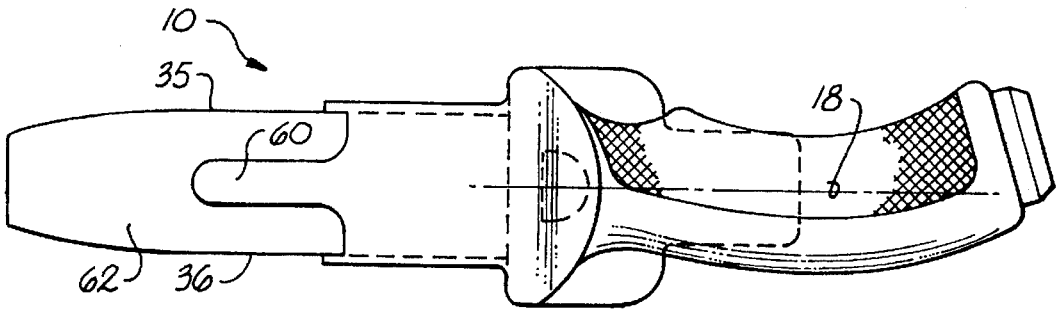
FIG. 5 is a plan view of a knife and sheath constructed in accordance with the present invention.

As illustrated in FIGS. 4 and 5, sheath B includes a body portion, generally 28, having an elongated blade receptacle, generally 30, for receiving blade 12 of knife A. Extending upwardly from receptacle 30 is a back portion 32, to which handle 14 is adjacent upon insertion of blade 12 within receptacle 30. The sheath B also includes a separate engagement member 34, which is pivotally attached to the sides 35, 36 of body portion 28. Engagement member 34 includes a downwardly extending engagement tab 38 which is engageable with notch 24 of knife handle 14 when blade 12 is received within sheath receptacle 30.

Figure 8:
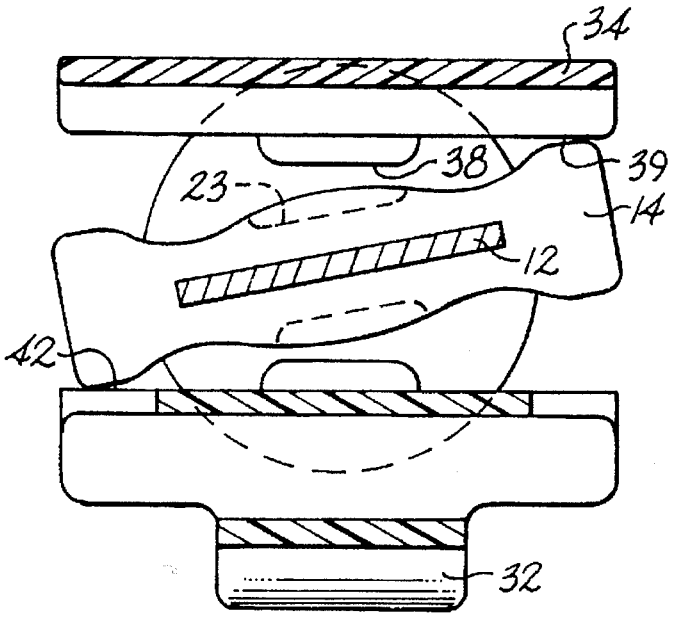
FIGS. 8 and 9 are sectional views similar to those illustrated in FIG. 7, illustrating disengagement of the engagement tab from the handle notch through the twisting movement of the handle, accomplished through contact of the transversely extending lifting member with the lateral engagement surface of the sheath's engagement member.
Figure 9:
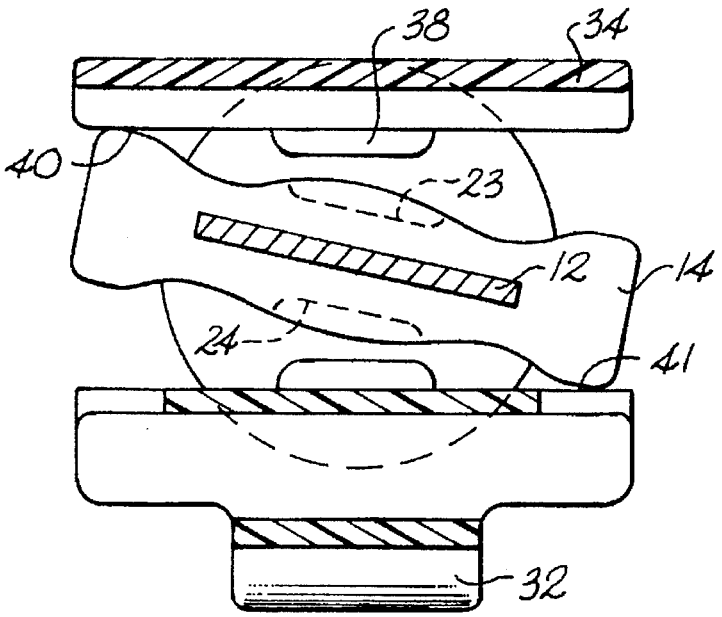

Engagement member 34 also includes laterally extending engagement surfaces 39, 40 which are engageable by lifting members 21, 22, when handle 14 is twisted about axis 18. Such twisting of handle 14 causes one lifting member 21, for example, to contact engagement surface 42, and for the other lifting member, for example, lifting member 22 to contact an engagement surface 39 on back portion 32 of the sheath, as is illustrated in FIG. 8. Twisting of handle 14 in the opposite direction would cause lifting member 22 to engage surface 41 of engagement member 34, and lifting member 21 to engage surface 40 of back portion 32 of the sheath, as illustrated in FIG. 9.

Through such contact of lifting members 21, 22 with the contact surfaces, respectively, an increased distance between engagement member 34 and back portion 32 is provided. When such distance increases sufficiently for engagement tab 38 to become disengaged with notch 24 of handle 14, the knife can be extracted from the sheath with a generally linear motion, due to the sliding engagement of lifting members 21, 22 with engagement member 34 and back portion 32, until tab 38 is no longer positioned above notch 24. This allows for quick, one-handed removal of the knife from the sheath without requiring the user to use his or her fingers for depressing a button, lever, or the like.

Figure 6:
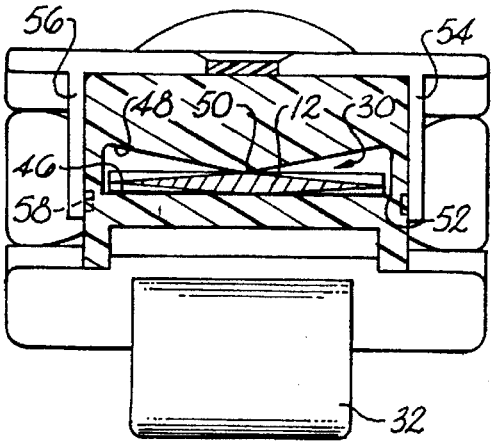
FIG. 6 is a sectional view taken along lines 6—6 of FIG. 4.

Turning now to FIG. 6, knife receptacle 30 in one preferred embodiment has a relatively flat back wall 46, while the front wall 48 thereof is of a flattened V-shape, when viewed in cross-section. The distance between back wall 46 and front wall 48 is minimized at the apex 50 of front wall 48. This allows for blade 12 of the knife to snugly fit in a relatively rattle-free manner within receptacle 30 in that there is minimal or no appreciable clearance between the blade 12 and apex 50 when blade 12 is inserted within receptacle 30. However, because of the flattened V-shape of front wall 48, blade 12 may still be rotated or twisted about axis 18 in order to release the knife from the sheath, as discussed above.

Figure 7:
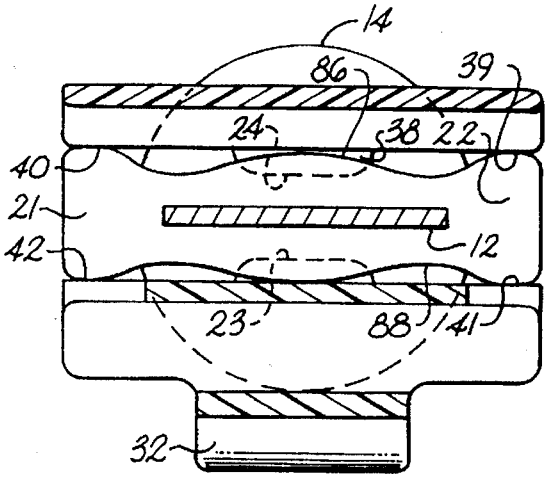
FIG. 7 is a sectional view taken along lines 7—7 of FIG. 4.

As illustrated in FIG. 7, the knife is shown in a locked configuration within the sheath, wherein engagement tab 38 is received within notch 24 of knife handle 14. In this configuration, lifting members 21, 22 rest adjacent to engagement surfaces 40, 42 and 39, 41, respectively.

Engagement member 34 is pivotally connected to the sides 35, 36 of the sheath after forming of the sheath. The pivotal connection between engagement member 34 and sides 35, 36 of the sheath can include posts, generally 52, being provided on legs 54, 56 of engagement member 34, with posts 52 being received in openings 58 defined respectively in sides 35, 36 of the sheath. Although not shown, this arrangement could be reversed such that legs 54, 56, receive outwardly extending posts provided on the sides of the sheath.

Engagement member 34 is also provided with a generally longitudinally extending cantilever finger 60, which bears against the front surface 62 of the sheath when engagement member 34 pivots. Finger 60 acts as a spring to bias engagement tab 38 downwardly towards sheath back portion 32 and also provides a spring resistance to movement of engagement tab 38 and engagement surfaces 39, 40 upwardly, when handle 14 is twisted during removal of the knife from the sheath.

The sheath preferably includes a clip, generally 64, provided on back portion 32. Clip 64 preferably includes a strap receiving passage 66, as well as a resilient retention finger 68. Retention finger 68 defines a belt passage 70 being selectively open at the free end 72 of finger 68. Free end 72 is upturned such that upon receipt of a strap or belt, such as belt 73 shown in FIG. 1, within passage 70, and finger 68 being resiliently biased back towards to the back side 74 of the sheath, upturned end 72 will serve to close the passage 70 for reducing the likelihood of the sheath from inadvertently coming loose off of the belt 73. At the extreme end of the sheath, a second strap passage 76 is defined for receiving a strap such as strap 78 shown in FIG. 1.

In one preferred embodiment, sheath B is constructed of molded plastic, and clip 64, including finger 68 and passage 66, and strap opening 76 are integrally formed in a single mold with the remainder of the sheath. Likewise, knife A is preferably constructed using a blade of cutlery steel and a handle molded from plastic, or formed from metal, ceramic materials, leather, wood, bone, or any other suitable materials.

By assembling engagement member 34 as a separate member from the sheath, engagement member 34 is allowed greater freedom in pivoting with respect to the sheath, than would generally be possible if engagement member 34 was molded integrally with the sheath. This method of constructing the engagement member separately allows for the sheath receptacle 30 to provide a snug fit for the blade 12 while still allowing sufficient flexibility for operation of the engagement member.

In operation of the knife and sheath combination 10, when it is desired to lock the knife within the sheath, the user holds handle 14 and inserts blade 12 into receptacle 30 using a generally linear motion until engagement tab 38 seats within notch 24 of knife handle 14. Upon seating of engagement tab 38 in notch 24, the knife is securely locked to the sheath. Engagement tab 38 is biased upwardly, against the spring force of finger 60 as it clears ridge portion 84 provided on the front of handle 14. Locking of the knife in the sheath is thus done easily and straightforwardly with a natural linear motion.

Unlocking of the knife from the sheath is performed by twisting of the knife handle generally about axis 18 of the knife. While this presents a relatively natural motion for the user, such a twisting motion around axis 18 would generally not be found in nature, such that inadvertent unlocking of the knife from the sheath wold generally not be caused by the user brushing against an object, such as a rock, reef, structure, etc. Twisting of handle 14 about axis 18 causes a further separation of engagement member 34 from back portion 32 due to interaction of lifting members 21, 22 with surfaces 40, 42 and 39, 41, respectively. The handle 14 is twisted such that engagement tab 38 clears notch 24 and ridge 84. This allows a generally linear motion to be applied to the handle for withdrawing the knife from the sheath. The engagement member 34, lifting surfaces 21, 22, tab 38, and notch 24 are all configured with respect to one another such that twisting of handle 14 through an angle causes the knife to be released from the sheath. Preferably, unlocking of the knife is achieved when the handle is rotated through an arc between approximately 5 degrees and 20 degrees about axis 18.

Figure 10:
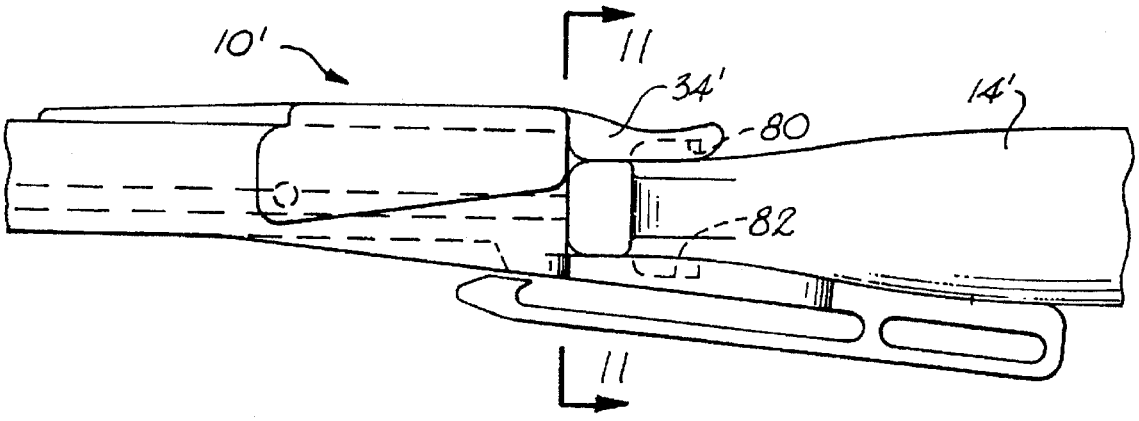
FIG. 10 is a side elevational view of an alternate embodiment of the present invention, wherein the handle of the knife includes an upstanding tab, and the engagement member of the sheath includes a notch for receiving the tab.
Figure 11:
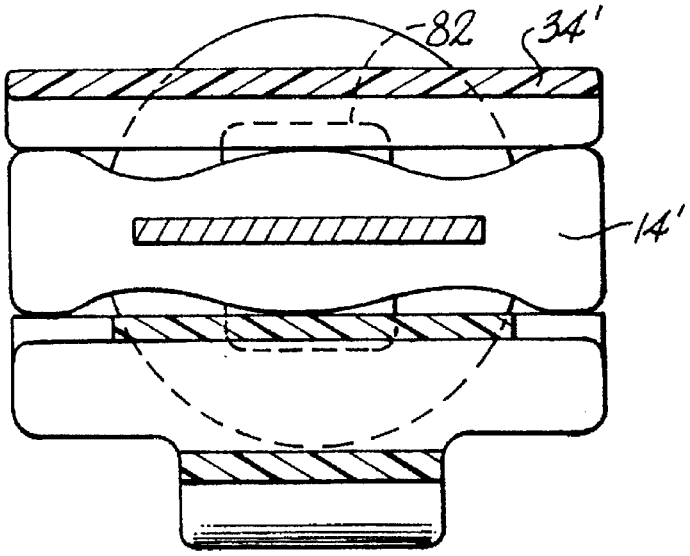
FIG. 11 is a sectional view taken along lines 11—11 of FIG. 10.
Figure 12:
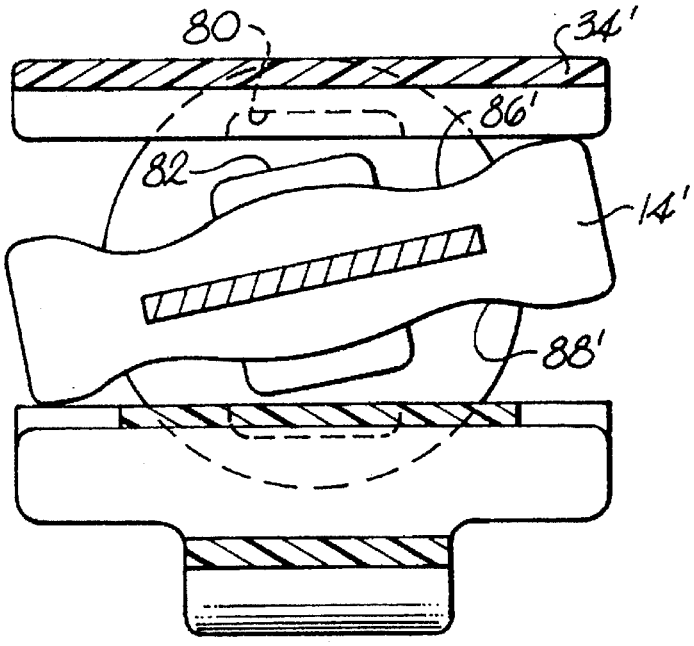
FIG. 12 is a view similar to that illustrated in FIG. 11, showing the handle of the knife in a twisted configuration for releasing the engagement tab of the handle from the notch in the engagement member of the sheath.

An alternate embodiment of the present invention is illustrated in FIGS. 10 through 12 and is designated generally by reference numeral 10'. FIGS. 10 through 12 illustrate a knife and sheath combination substantially the same as discussed above, except that instead of engagement tab being provided on engagement member 34, engagement member 34' includes a notch 80 which receives the knife handle catch 82 provided on each side of handle 14'. The operation of the alternate embodiment knife sheath is accordingly similar to that discussed with regards to embodiment 10 above, except that in locking the knife to the sheath, projection 82 of handle 14' is received within recess 80 of engagement member 34'. In removing the knife from the sheath, the handle is twisted until recess 80 no longer engages with projection 82 of the handle.

It is noted that because notches 23, 24 are provided upon each side of handle 14, respectively, and a projection 82 is provided on each side of handle 14', the knife of each embodiment can be inserted into the sheath with either of sides 86, 88 or 86', 88', respectively, facing outwardly. Because the knife can be inserted in either of two orientations, it is not necessary for the user to even look at the knife or feel a certain portion on the handle prior to inserting it into the sheath in order to insure that the knife is locked into the sheath. The knife is automatically locked in the sheath by merely inserting the blade into the blade receptacle a sufficient distance.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A knife and sheath combination, comprising:

a knife having a blade with a handle, said handle having a blade guard adjacent said blade; said blade guard having at least one transversely extending lifting member extending outwardly from said handle;

a sheath having a body portion defining a blade receptacle for receiving said blade and a back portion adjacent said blade receptacle; and said sheath including a lateral engagement portion;

said knife handle including a first locking portion laterally spaced from said transversely extending lifting member, and said sheath including a second locking portion laterally spaced from said lateral engagement portion for cooperating with said first locking portion of said knife handle upon receipt of said blade in said blade receptacle for locking said knife to said sheath; and said second locking portion being connected to said body member of said sheath for movement between a locking position, wherein said second locking portion engages said first locking portion, and an unlocking position, wherein said second locking portion is disengaged from said first locking portion for allowing release of said knife from said sheath, said second locking portion being moved from said locking position to said unlocking position through contact of said transversely extending lifting member of said knife with said lateral engagement portion of said sheath.

2. A knife and sheath combination as set forth in claim 1, wherein said first locking portion is a notch defined in said handle, and said second locking portion includes an engagement member having an engagement tab extending outwardly therefrom for engagement with said notch of said handle when said blade is inserted in said blade receptacle.

3. A knife and sheath combination as set forth in claim 1, wherein said first locking portion includes a projection provided on said handle, and said second locking portion includes an engagement member defining a recess therein for engagement with said projection of said handle when said blade is inserted in said blade receptacle.

4. A knife and sheath combination as set forth in claim 1, wherein said handle defines a longitudinal axis and wherein said first locking portion is substantially centered about said longitudinal axis of said handle.

5. A knife and sheath combination as set forth in claim 1, wherein said first locking portion is adjacent said blade guard of said handle.

6. A knife and sheath combination as set forth in claim 1, wherein said handle includes a first side and a second side opposite said first side, and wherein each of said first and second sides includes at least one said transversely extending lifting member.

7. A knife and sheath combination as set forth in claim 1, wherein said handle has a front portion and a back portion opposite said front portion, and wherein each of said front and back portions includes a said first locking portion.

8. A knife and sheath combination as set forth in claim 1, wherein said sheath includes a clip provided on said back portion of said sheath.

9. A knife and sheath combination as set forth in claim 1, wherein said second locking portion is pivotally connected to said sheath.

10. A knife and sheath combination as set forth in claim 1, wherein said engagement member is pivotally connected to said body portion of said sheath and further comprising a spring connected to said engagement member for biasing said engagement member towards said locking position.

11. A knife and sheath combination as set forth in claim 1, wherein said body portion of said sheath defines a V-shaped portion extending into said blade receptacle, and said V-shaped portion having an apex portion contactable with a portion of said blade when said blade is inserted into said blade receptacle.

12. A knife and sheath combination, comprising:

a knife having a blade with a handle defining a longitudinal axis, said handle having a blade guard adjacent said blade; said blade guard having at least one transversely extending lifting member extending outwardly from said handle; and said handle defining a notch laterally spaced from said at least one transversely extending lifting member; and a sheath having a body portion defining a blade receptacle for receiving said blade and a back portion extending from said blade receptacle; said sheath including an engagement member having an engagement tab extending outwardly therefrom and a lateral engagement portion laterally spaced from said engagement tab; said engagement member being connected to said body member for movement between a locking position, wherein said engagement tab engages said notch in said handle upon receipt of said blade by said blade receptacle to lock said blade in said blade receptacle, and an unlocking position, wherein said tab is disengaged from said notch for allowing release of said knife from said sheath; and said engagement member being moved from said locking position to said unlocking position through contact of said transversely extending lifting member of said knife with said lateral engagement portion.

13. A knife and sheath combination as set forth in claim 12, wherein:

said first locking portion is substantially centered about said longitudinal axis of said handle;

said handle has a front portion and a back portion opposite said front portion, and wherein each of said front and back portions includes said handle defining a said notch therein; and said engagement member is pivotally connected to said body portion of said sheath.

14. A method of locking a knife in a sheath and for unlocking the knife from the sheath, the method comprising:

providing a knife having a blade with a handle defining a longitudinal axis and at least one transversely extending lifting member;

providing a sheath having a body portion defining a blade receptacle for receiving said blade and including a lateral engagement portion;

providing a first locking portion on said knife laterally spaced from said transversely extending lifting member and a second locking portion on said sheath laterally spaced from said lateral engagement portion moveable to a locking position for locking with said first locking portion;

inserting said blade into said blade receptacle of said sheath such that said second locking portion cooperates with said first locking portion to lock said knife to said sheath;

twisting said knife handle about said longitudinal axis such that said lifting member contacts and moves said second locking portion to said unlocking position; and pulling outwardly on said handle such that said first locking portion disengages with said second locking portion and so that said knife is separated from said sheath.

15. A knife and sheath combination, comprising:

a knife having a blade with a handle defining a longitudinal axis, said handle having a blade guard adjacent said blade; said blade guard having at least one transversely extending lifting member extending outwardly from said handle; and said handle having a projection laterally spaced from said at least one transversely extending lifting member; and a sheath having a body portion defining a blade receptacle for receiving said blade and a back portion extending from said blade receptacle; said sheath including an engagement member defining a recess therein and a lateral engagement portion laterally spaced from said recess; said engagement member being connected to said body member for movement between a locking position, wherein said projection engages said recess in said engagement member upon receipt of said blade by said blade receptacle to lock said blade in said blade receptacle, and an unlocking portion, wherein said projection is disengaged from said recess for allowing release of said knife from said sheath; and said engagement member being moved from said locking position to said unlocking position through contact of said transversely extending lifting member of said knife with said lateral engagement portion.

* * * * *